United States Patent [19]

Tsuchida et al.

[11] Patent Number: 4,610,497

[45] Date of Patent: Sep. 9, 1986

[54] LAMP SOCKET DEVICE

[75] Inventors: Yoshihiro Tsuchida; Shigeru Tamura; Yoshio Koda, all of Niigata, Japan

[73] Assignee: Nippon Seiki Kabushiki Kaisha, Niigata, Japan

[21] Appl. No.: 555,612

[22] Filed: Nov. 28, 1983

[30] Foreign Application Priority Data

Nov. 30, 1982 [JP] Japan ..... 57-182245[U]

[51] Int. Cl.[4] ..... H01R 11/22

[52] U.S. Cl. ..... 339/176 L; 339/217 R

[58] Field of Search ..... 339/176 L, 217 S, 256 SP, 339/258 F, 217 R, 256 R, 258 R

[56] References Cited

U.S. PATENT DOCUMENTS

| | | | |
|---|---|---|---|
| 3,697,934 | 10/1972 | Merry | 339/258 R |
| 3,853,389 | 12/1974 | Occhipinti | 339/217 S |
| 3,936,131 | 2/1976 | Durand | 339/176 L |
| 4,361,773 | 11/1982 | Mokrzycki | 339/217 S |
| 4,473,770 | 9/1984 | Baba et al. | 339/176 L |

FOREIGN PATENT DOCUMENTS

| | | | |
|---|---|---|---|
| 1489446 | 4/1969 | Fed. Rep. of Germany | 339/102 L |
| 1247850 | 9/1971 | United Kingdom | 339/176 L |
| 1294521 | 11/1972 | United Kingdom | 339/176 L |

*Primary Examiner*—Gil Weidenfeld
*Assistant Examiner*—Gary F. Paumen
*Attorney, Agent, or Firm*—Lowe, Price, LeBlanc, Becker & Shur

[57] ABSTRACT

A lamp socket device includes a socket body preferably made of a resilient material and a pair of electrically conductive terminals disposed therein and each including clamping portions having free ends bent as locking arms and a base having a locking hook bent from an upper edge thereof in a direction transverse to the locking arms. The locking arms and hooks are held in engagement with inner walls of the socket body which are positioned in mutually transverse relation. The terminals are thus easily and firmly mounted in place in the socket body against undesirable electric faults such as short-circuiting while the lamp socket device is used in a vibratory condition. Waterproof sealing characteristics and vibration resistance of the socket are improved by forming the socket body of resilient material.

23 Claims, 15 Drawing Figures

LAMP SOCKET DEVICE

BACKGROUND OF THE INVENTION

1. Field of the Invention

The present invention relates to a lamp-push-in type lamp socket device for use in vibratory conditions under exposure to an outer atmosphere, such as for illuminating the indicator of a meter on motorcycles, and more particularly to a lamp socket device preferably made of a resilient material and having a pair of electrically conductive terminals fixedly positioned therein for preventing an electric fault or trouble under vibratory conditions.

2. Description of the Prior Art

Prior lamp socket devices have been disadvantageous in that electrically conductive terminals thereof tend to be displaced out of mutual alignment due to forces applied when the lamp socket is attached or removed or other external causes such as vibrations applied to the lamp socket. If the terminals are misaligned or irregularly positioned, then a lamp body cannot be inserted in position smoothly. An additional problem with the conventional lamp socket designs is that the terminals are liable to fall toward the center, forming a short circuit.

SUMMARY OF THE INVENTION

It is an object of the present invention to provide a lamp socket device having a pair of electrically conductive terminals mounted securely in position therein against misalignment or displacement toward the center due to forces imposed when the lamp socket is attached or removed or due to external causes such as vibrations, thereby preventing undesirable electric faults or troubles under vibratory conditions and allowing smooth insertion of a lamp body into the lamp socket. It is another object of the present invention to provide a lamp socket device having a socket body made of a resilient material for improving vibration resistance and waterproof sealing characteristics.

According to the present invention, a lamp socket device for use with a push-in lamp body has a pair of electrically conductive terminals accommodated in a socket body in laterally spaced relation from each other for electric contact with the lead wires of the lamp body. Each of the terminals includes a base and a pair of clamping portions extending from the base and having bent locking arms held in engagement with inner walls of the socket body, the base having a locking hook extending from an edge thereof in a direction transverse to the locking arms and held in engagement with an inner wall of the socket body. The terminals can be retained in the socket body by the locking arms and hook which extend in transverse relation against positional misalignment which would be occasioned by the insertion of the lamp body or electric faults such as short-circuiting under vibratory conditions.

The above and other objects, features and advantages of the present invention will become more apparent from the following description when taken in conjunction with the accompanying drawings in which preferred embodiments of the present invention are shown by way of illustrative example, and like reference characters designate like parts throughout.

DESCRIPTION OF THE PREFERRED EMBODIMENTS

Figure 4:
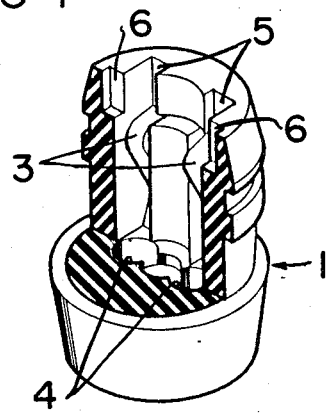
FIG. 4 is a perspective view, partly cut away, of a socket body according to the present invention.
Figure 10:
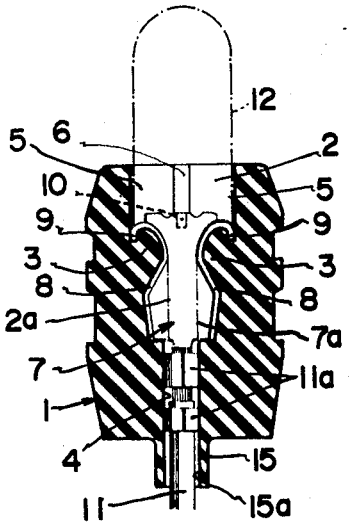
FIG. 10 is a cross-sectional view of the socket body shown in FIG. 7, illustrating the manner in which locking arms of the terminals engage the inner walls of the socket body.

A lamp socket device according to an embodiment of the present invention includes a bottomed, hollow socket body 1, as shown in FIGS. 4 and 10, molded of a soft resilient material such as rubber. The socket body 1 has therein a first upper cavity 2 and a second layer cavity 2*a* communicating therewith and connected thereto by a constricted throat defined by bulging portions 3 confronting each other and projecting toward a central axis of the socket body 1.

Figure 7:
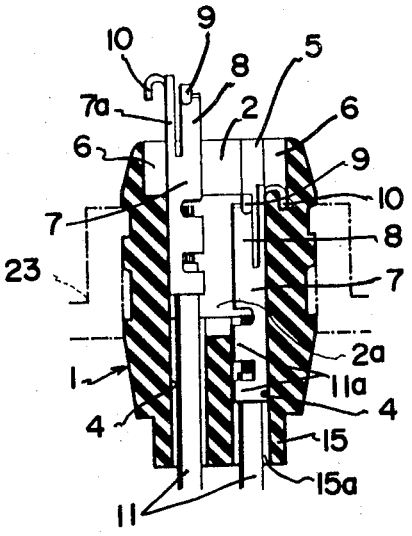
FIG. 7 is a cross-sectional view of the socket body, illustrative of the manner in which locking hooks of the terminals engage inner walls of the socket body.

As illustrated in FIGS. 4 and 7, the socket body 1 has in its bottom a pair of holes 4 communicating with the second cavity 2*a*.

Figure 5:
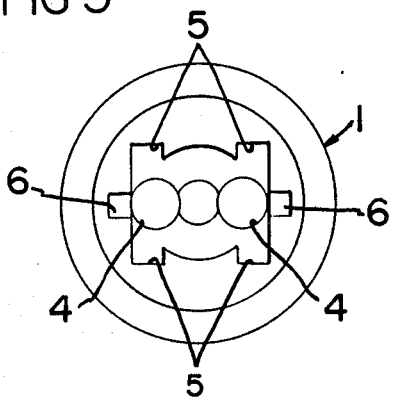
FIG. 5 is a plan view of the socket body illustrated in FIG. 4.

In FIGS. 4 and 10, the socket body 1 has a pair of first slots 5 defined in peripheral walls of the first cavity 2 above the bulging portions 3 and spaced from each other by substantially the same distance as that between the holes 4. The socket body 1 also has a pair of second slots 6 defined in peripheral walls of the first cavity 2 in alignment with a straight line extending axially through the holes 4. As shown in FIG. 5, the first and second slots 5, 6 extend in perpendicular relation when locked at in plan view.

Figure 1:
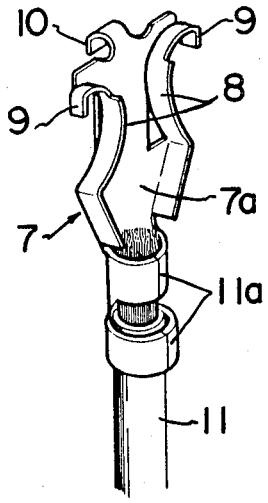
FIG. 1 is a perspective view of electrically conductive terminals according to the present invention.
Figure 2:
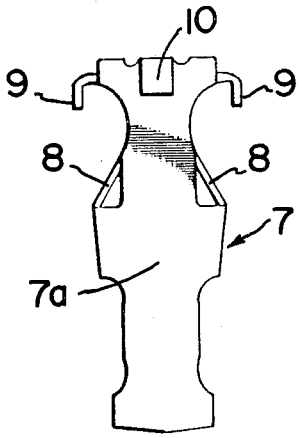
FIG. 2 is a front elevational view of the terminals shown in FIG. 1.
Figure 3:
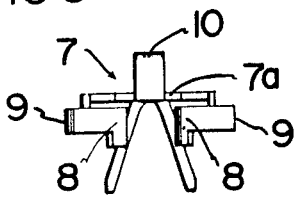
FIG. 3 is a plan view of the terminals of FIG. 1.
Figure 6:
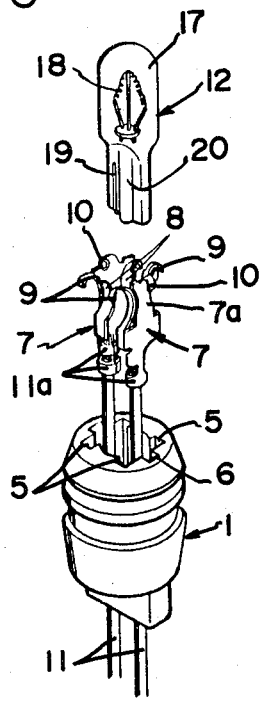
FIG. 6 is an exploded perspective view of a lamp body, the terminals, and the socket body.

The lamp socket device has a pair of electrically conductive terminals 7 as shown in FIGS. 6 and 7. As illustrated in FIGS. 1 through 3, each of the terminals 7 has a pair of clamping portions 8, from which extend narrower locking arms 9 bent into hooks as free ends. The terminal 7 has a base portion 7*a* having on its upper edge a narrower locking hook 10 bent outwardly.

As shown in FIG. 3, the locking arms 9 and the locking hook 10 extend in perpendicular relation. To the lower edges of the terminals 7, there are connected by clamps 11*a* the free ends of independent electric cords 11 as shown in FIGS. 6 and 7.

In FIGS. 6, 7 and 10, the terminals 7 with the electric cords 11 connected thereto are housed in laterally spaced relation in the first and second cavities 2, 2*a* in the socket body 1. A wedge-base lamp body 12 is then inserted through the upper opening in the socket body 1 into the latter until the lamp body 12 is clamped under pressure between the base portions 7*a* and the clamping portions 8 of the opposite terminals 7.

At this time, the clamps 11*a* clamping the electric cords 11 at the lower edges of the terminals 7 are inserted respectively into the holes 4 in the bottom of the socket body 1, with the clamping portions 8 being tightly fitted in the second cavity 2*a* and urged in a direction to close the open end of the second cavity 2*a*. The locking arms 9 of the clamping portion 8 are inserted respectively in the first slots 5 and extend along the upper surfaces of the bulging portions 3 positioned below the first slots 5, as shown in FIG. 10. The locking hook 10 on the upper edge of the base portion 7*a* of each terminal 7 is inserted into one of the second slots 6 until the locking hook 10 is engaged by the lower end of the second slot 6.

Figure 8:
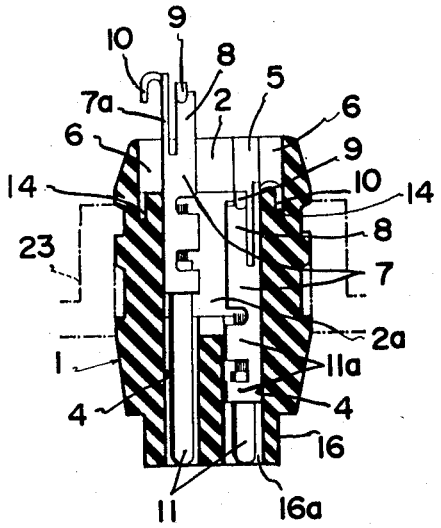
FIGS. 8 and 9 are cross-sectional views similar to FIG. 7, showing modifications.
Figure 11:
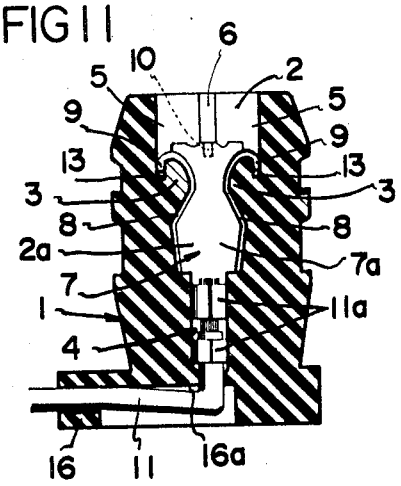
FIGS. 11 and 12 are cross-sectional views similar to FIG. 10, showing the socket bodies of FIGS. 8 and 9, respectively.

According to a modification shown in FIGS. 8 and 11, the socket body 1 has first locking grooves 13 (FIG. 11) defined in the upper surfaces of the bulging portions 3 below the first slots 5 in communication therewith, and second locking grooves 14 (FIG. 8) defined below the second slots 6 in communication therewith. The locking arms 9 are retained respectively in the first locking grooves 13, and the locking hooks 10 are retained respectively in the second locking grooves 14.

As shown in FIGS. 7 and 10, the socket body 1 has a guide 15 depending from the bottom thereof for guiding the electric cords 11 longitudinally of the socket body 1. With the modified arrangement of FIGS. 8 and 11, the socket body 1 has a guide 16 extending on the bottom thereof in a direction normal to the longitudinal axis of the socket body 1. These guides 15, 16 have passages 15*a*, 16*a*, respectively, leading to the holes 4 in the bottom of the socket body 1.

As illustrated in FIG. 6, the lamp body 12 comprises a bulb or envelope 17, a filament 18 sealed in the bulb 17, and thin lead wires 19 connected to the filament 18 and leading out of the bulb 17. The lamp body 12 has a lower end flattened as a sealed portion 20, the lead wires 19 extending through and out of the flat sealed portion 20 and turned upwardly therealong.

When the lamp body 12 is inserted into the socket body 1, the flat sealed portion 20 is forcibly sandwiched between the clamping portions 8 of the terminals 7 placed in the second cavity 2*a* in the socket body 1, whereupon the lead wires 19 are brought into electric contact with the terminals 7 to make an electric circuit. At the same time, the bulb 17 of the lamp body 12 is partly received and supported in the first cavity 2 in the socket body 1.

Figure 9:
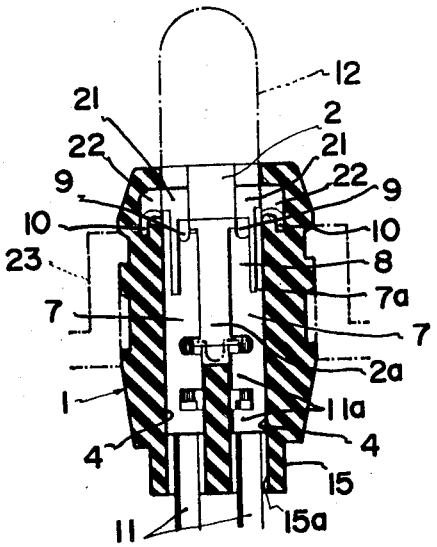
Figure 12:
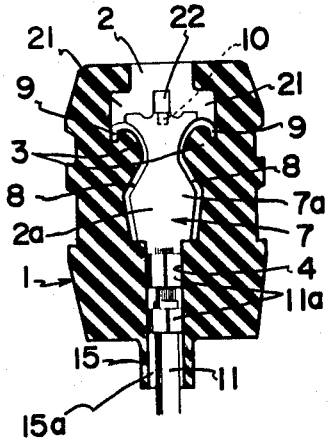

According to another modification shown in FIGS. 9 and 12, the locking arms 9 are accommodated respectively in laterally opening recesses 21 (FIG. 12) defined in the socket body 1, and the locking hooks 10 are accommodated respectively in laterally opening recesses 22 defined in the socket body 1.

With the arrangement of the present invention, the flat sealed portion 20 of the lamp body 12 is forcibly clamped between the clamping portions 8 and base portions 7*a* of the terminals 7 put in the second cavity 2*a* in the socket body 1, so that the lead wires 19 extending along the sealed portion 20 are brought into electric contact with the clamping portions 8. The bulb 17 of the lamp body 12 is partly retained in the first cavity 2 in the socket body 1. Therefore, the lamp body 12 can easily and durably be held in electric contact with the terminals 7 in the socket body 1.

Figure 13:
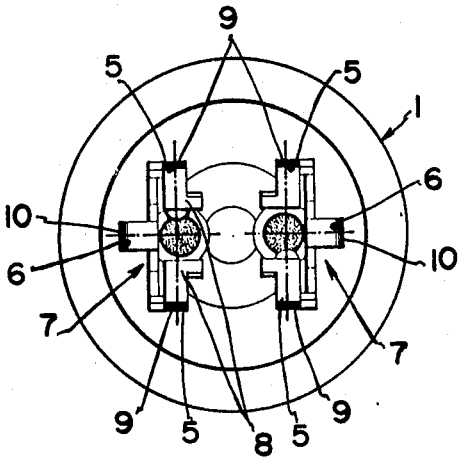
FIG. 13 is a plan view of the socket body with the terminals mounted therein.

More specifically, the free ends of the clamping portions 8 of the terminals 7 are bent outwardly as hook-shaped locking arms 9 engaging inner walls of the first cavity 2 in the socket body 1, and the locking hooks 10 are bent outwardly from the upper edges of the base portions 7*a* of the terminals 7 and held in engagement with inner walls of the first cavity 2 in the socket body 1. The locking hooks 10 and the locking arms 9 extend in transverse or mutually perpendicular relation and serve to keep the pair of terminals 7 engaging in the socket body 1. As a consequence, each of the terminals 7 is supported by three points of engagement with the socket body 1 which are positioned on perpendicular lines as shown in FIG. 13. The terminals 7 can thus be inserted and retained easily and durably in position in the socket body 1.

Figure 14:
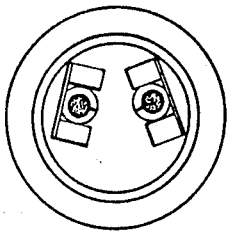
FIG. 14 is a plan view showing irregularly positioned terminals of the prior art.
Figure 15:
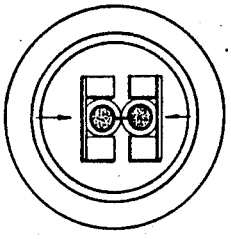
FIG. 15 is a plan view showing prior terminals displaced to the center.

The terminals 7 thus maintained in position by the mutually perpendicularly oriented locking arms 9 and locking hooks 10 are prevented from being irregularly positioned or misaligned, as shown in FIG. 14, when the socket body 1 is attached to or removed from a fixed member 23 (FIGS. 7 through 9) or when subjected to vibrations or other causes of trouble. Therefore, the lamp body 12 can easily be inserted into the socket body 1 without the problem of getting caught which would be occasioned by misaligned terminals. The terminals 7 are also prevented from falling toward the center of the socket body 1, as shown in FIG. 15, into short-circuiting relation.

The positive engagement of the locking arms 9 and the locking hooks 10 with the socket body 1 serves to retain the terminals 7 firmly within the socket body 1 against the danger of getting pulled out when the electric cords 11 are handled or moved around under tension.

The terms "upper", "lower", "above", "below" used in the foregoing description and the following claims are employed with reference to the lamp socket device as it is positioned vertically with the first cavity 2 opening upwardly and the guides 15, 16 directed downwardly.

Although certain preferred embodiments have been shown and described, it should be understood that many changes and modifications may be made therein without departing from the scope of the appended claims.

What is claimed is:

1. A lamp socket device for use with a push-in lamp body having lead wires, comprising:

(a) a socket body having a hollow space therein for partly receiving the push-in lamp body; and (b) a pair of electrically conductive terminals accommodated in said hollow space in laterally spaced relation from each other for electric contact with the lead wires of the push-in lamp body, each of said electrically conductive terminals including a base and a pair of clamping portions extending transversely from said base and having bent locking arms held in engagement with inner walls defining said hollow space, said base having a locking hook extending from an edge thereof in said lateral direction transverse to said locking arms and held in engagement with an inner wall defining said hollow space, and, (c) perpendicularly oriented retaining means in said socket body for engaging said locking arms and said locking hooks for preventing lateral and transverse movement of said terminals in said socket body.

2. A lamp socket device according to claim 1, wherein said socket body has a bottom, said hollow space being composed of a first upper cavity and a second lower cavity communicating therewith through a constricted throat, said socket body having bulging portions confronting each other and projecting toward a central axis of said socket body, said constricted throat being defined by said bulging portions.

3. A lamp socket device according to claim 2, wherein said retaining means of said socket body has a pair of transversely displaced first vertical slots defined in peripheral walls defining said first cavity above said bulging portions for receiving each of said locking arms and preventing lateral displacement thereof, and laterally displaced second vertical slots defined in peripheral walls defining said first cavity in transverse relation to said first slots for receiving said locking and preventing transverse displacement thereof.

4. A lamp socket device according to claim 3, wherein said socket body is made of a resilient material, said locking arms each having a U-shaped hook means for insertion in said first slots for locking said terminals from transverse movement within said socket body and extending along first grooves in upper surfaces of said bulging portions, said locking hooks being inserted in said second slots and held in engagement with said grooves in lower ends of said second slots for locking said terminals from lateral movement within said socket body.

5. A lamp socket device according to claim 3, wherein said socket body has first horizontal locking grooves defined in upper surfaces of said bulging portions below said first slots in communication therewith, said locking arms having portions retained in said first locking grooves to prevent transverse movement of said terminals, and second horizontal locking grooves defined below said second slots in communication therewith, said locking hooks being retained in said second locking grooves to prevent lateral movement of said terminals.

6. A lamp socket device according to claim 2, wherein said retaining means of said socket body has first recesses defined in peripheral walls defining said first cavity above said bulging portions for receiving said locking arms, and second recesses defined in peripheral walls defining said first cavity in transverse relation to said first recesses for receiving said locking hooks.

7. A lamp socket device according to claim 2, including said push-in lamp body, said push-in lamp body having a bulb and a flattened sealed portion extending therefrom, said clamping portions being inserted in said second cavity, said flattened sealed portion being clamped between said clamping portions and base portions of said electrically conductive terminals, said bulb being partly received in said first cavity.

8. A lamp socket device for use with a push-in lamp body having lead wires comprising:

(a) a socket body having a bottom, hollow space therein for partly receiving the push-in lamp body and being made of resilient material, said hollow space being composed of a first upper cavity and a second lower cavity communicating therewith through a constricted throat, said socket body having bulging portions confronting each other and projecting toward a central axis of said socket body, said constricted throat being defined by said bulging portions; and (b) a pair of electrically conductive terminals accommodated in said hollow space in laterally spaced relation from each other for electric contact with the lead wires of the push-in lamp body, each of said lead wires leading out of the bottom portion of said socket body, each of said electrically conductive terminals including a base and a pair of clamping portions extending from said base and having bent locking arms held in engagement with inner walls defining said first cavity, said base having a locking hook extending from an edge thereof in a direction transverse to said locking arms and held in engagement with an inner wall defining said first cavity, said push-in lamp body having a bulb and a flattened sealed portion extending therefrom, said clamping portions being in said throat, said flattened sealed portion being clamped by said clamping portions, said bulb being partly received in said first cavity whereby said electrically conductive terminals are retained in said socket body by said locking arms and hook.

9. A lamp socket device according to claim 8, wherein said socket body has a pair of holes defined in said bottom and communicating with said second cavity, said electrically conductive terminals having lower ends, further including electric cords having ends with said lower ends of the terminals clamped thereto, and inserted respectively in said holes in said bottom of the socket body.

10. A lamp socket device according to claim 9, wherein said socket body includes a guide depending from said bottom thereof and having a passage communicating with said holes defined in said bottom, said electric cords being guided by said guide longitudinally of said socket body.

11. A lamp socket device according to claim 9, wherein said socket body includes a guide extending on said bottom in a direction normal to the longitudinal direction of said socket, and having a passage communicating with said holes defined in said bottom, said electric cords being guided by said guide in said first-mentioned direction.

12. A lamp socket device according to claim 8, wherein said socket body has first slots defined in peripheral walls defining said first cavity above said bulging portions for receiving said locking arms, and second slots defined in peripheral walls defining said first cavity in transverse relation to said first slots for receiving said locking hooks, said locking arms being inserted in said first slots and extending along upper surfaces of said bulging portions, said locking hooks being inserted in said second slots and held in engagement with lower ends of said second slots.

13. A lamp socket device according to claim 8, wherein said socket body has first slots defined in peripheral walls defining said first cavity above said bulging portions for receiving said locking arms, and second slots defined in peripheral walls defining said first cavity in transverse relation to said first slots for receiving said locking hooks, said socket body further having first locking grooves defined in upper surfaces of said bulging portions below said first slots in communication therewith, said locking hooks being retained in said first locking grooves, and second locking grooves defined below said second slots in communication therewith, said locking hooks being retained in said second locking grooves.

14. A lamp socket device according to claim 8, wherein said socket body has first recesses defined in peripheral walls defining said first cavity above said bulging portions for receiving said locking arms, and second recesses defined in peripheral walls defining said first cavity in transverse relation to said first recesses for receiving said locking hooks.

15. A lamp socket device according to claim 12, wherein said socket body has a pair of holes defined in said bottom and communicating with said second cavity, said electrically conductive terminals having lower ends, further including electric cords having ends with said lower ends of the terminals clamped thereto, and inserted respectively in said holes in said bottom of the socket body.

16. A lamp socket device according to claim 13, wherein said socket body has a pair of holes defined in said bottom and communicating with said second cavity, said electrically conductive terminals having lower ends, further including electric cords having ends with said lower ends of the terminals clamped thereto, and inserted respectively in said holes in said bottom of the socket body.

17. A lamp socket device according to claim 14, wherein said socket body has a pair of holes defined in said bottom and communicating with said second cavity, said electrically conductive terminals having lower ends, further including electric cords having ends with said lower ends of the terminals clamped thereto, and inserted respectively in said holes in said bottom of the socket body.

18. A lamp socket device according to claim 15, wherein said socket body includes a guide depending from said bottom thereof and having a passage communicating with said holes defined in said bottom, said electric cords being guided by said guide longitudinally of said socket body.

19. A lamp socket device according to claim 16, wheren said socket body includes a guide depending from said bottom thereof and having a passage communicating with said holes defined in said bottom, said electric cords being guided by said guide longitudinally of said socket body.

20. A lamp socket device according to claim 17, wherein said socket body includes a guide depending from said bottom thereof and having a passage communicating with said holes defined in said bottom, said electric cords being guided by said guide longitudinally of said socket body.

21. A lamp socket device according to claim 15, wherein said socket body includes a guide extending on said bottom in a direction normal to the longitudinal direction of said socket, and having a passage communicating with said holes defined in said bottom, said electric cords being guided by said guide in said first-mentioned direction.

22. A lamp socket device according to claim 16, wherein said socket body includes a guide extending on said bottom in a direction normal to the longitudinal direction of said socket, and having a passage communicating with said holes defined in said bottom, said electric cords being guided by said guide in said first-mentioned direction.

23. A lamp socket device according to claim 17, wherein said socket body includes a guide extending on said bottom in a direction normal to the longitudinal direction of said socket, and having a passage communicating with said holes defined in said bottom, said electric cords being guided by said guide in said first-mentioned direction.

* * * * *